US006717379B1

(12) United States Patent
Andersson

(10) Patent No.: US 6,717,379 B1
(45) Date of Patent: Apr. 6, 2004

(54) DEVICE FOR GENERATING MECHANICAL VIBRATION

(76) Inventor: Ulf Bertil Andersson, Ö.Strandgatan 3, 371 38 Karlskrona (SE)

( * ) Notice: Subject to any disclaimer, the term of this patent is extended or adjusted under 35 U.S.C. 154(b) by 0 days.

(21) Appl. No.: 09/936,873

(22) PCT Filed: Mar. 13, 2000

(86) PCT No.: PCT/SE00/00487

§ 371 (c)(1),
(2), (4) Date: Sep. 18, 2001

(87) PCT Pub. No.: WO00/55430

PCT Pub. Date: Sep. 21, 2000

(30) Foreign Application Priority Data

Mar. 18, 1999 (SE) ..... 9900990

(51) Int. Cl.[7] ..... E01C 19/38
(52) U.S. Cl. ..... 318/114; 404/117
(58) Field of Search ..... 310/20, 51, 80, 310/81, 82; 318/114; 404/117

(56) References Cited

U.S. PATENT DOCUMENTS

| | | | | |
|---|---|---|---|---|
| 3,871,788 A | | 3/1975 | Barsby | 404/117 |
| 3,966,344 A | | 6/1976 | Haker et al. | 404/117 |
| 4,221,499 A | | 9/1980 | Breitholz et al. | 404/117 |
| 4,342,523 A | | 8/1982 | Salani | 404/117 |
| 5,355,732 A | * | 10/1994 | Anderl et al. | 73/672 |
| 5,618,133 A | | 4/1997 | Mitsui et al. | 404/117 |
| 5,797,699 A | | 8/1998 | Blancke et al. | 404/117 |
| 6,105,685 A | * | 8/2000 | Bald | 173/49 |
| 6,263,750 B1 | * | 7/2001 | Maurer et al. | 74/61 |

FOREIGN PATENT DOCUMENTS

| | | | |
|---|---|---|---|
| DE | 42 18 951 | | 10/1992 |
| DE | 004407013 A1 | * | 9/1995 |
| WO | WO 97/06308 | | 2/1997 |
| WO | W0 98/50171 | * | 11/1998 |

* cited by examiner

*Primary Examiner*—Karl Tamai
*Assistant Examiner*—Judson H. Jones
(74) *Attorney, Agent, or Firm*—Walter Ottesen

(57) ABSTRACT

The invention concerns a device where creation of mechanical vibration is made with a system (1) of two or more rotating eccentrics (10). Each eccentric (10) is rotated by an individually controlled motor (11) and the angle position of each eccentric (10) is read by an angle sensor (12). With a control and monitoring system (5), the rotation frequency, direction of rotation and phase position of each eccentric (10) can be controlled. By choosing a number of eccentrics, mass of the eccentrics, rotation frequency, direction of rotation and phase position, a force vector diagram of suitable form, in space and time, can be generated. The invention is intended primarily for use in appliances for dynamic compaction of various materials.

3 Claims, 6 Drawing Sheets

DEVICE FOR GENERATING MECHANICAL VIBRATION

FIELD OF THE INVENTION

The invention presented concerns a device for generating mechanical vibration, intended primarily for dynamic compaction of various sorts of material.

BACKGROUND OF THE INVENTION

For compacting various materials, e.g., in the construction of roads, airfields, vibratory compaction equipment is used to increase the compaction capacity and optimise the result of the compaction work. Optimisation can consist, for example, of increasing the density of the material, increasing its bearing capacity, achieving a certain density profile with regard to depth and of obtaining a particular surface structure. The equipment used can, for example, be rollers that have one or more vibrating drums, self-propelled vibratory plates, vibratory pokers and tampers.

To create the vibration, various types of mechanical systems having rotating eccentrics that utilise centrifugal force are used. This gives in space a rotating circular force vector and in time a sine shaped force vector in a certain direction.

To optimise compaction with regard to properties of the compacted material it is necessary that the vibration be given varying frequency, amplitude and direction.

Known vibratory devices with rotating eccentrics alter parameters of the force vector in the following way:

Examples of systems with one eccentric for achieving a circular force vector with variable amplitude:

See

U.S. Pat. No. 5,618,133 Vibrating mechanism and apparatus for generating . . .

U.S. Pat. No. 4,342,523 High-low force amplitude device

U.S. Pat. No. 4,221,499 Vibratory device

U.S. Pat. No. 3,966,344 Adjustable vibratory roller

Amplitude of the vibration is changed in that the centre of mass for the eccentric weight is displaced in relation to the rotation centre of the eccentric. The vibration frequency is set with the speed of rotation of the rotating eccentric. This is achieved at present by some type of mechanical system.

Systems with two eccentrics:

See U.S. Pat. No. 5,797,699 Process and apparatus for dynamic soil compaction. A linear force vector is obtained by the two eccentrics rotating in different directions of rotation and fully synchronised, ie, at the same speed of rotation. By phase displacement of the eccentrics so that the direction is changed as the eccentrics pass each other, the force vector can be controlled to act in varying directions. Phase displacement of the eccentrics is made by a mechanical system. Vibration frequency is set with the speed of rotation of the rotating eccentrics.

Characteristic for present vibration systems is that they only permit some specific form of vibration and that complicated mechanical devices are required.

SUMMARY OF THE INVENTION

The object of the invention presented is to optimise compaction with consideration to many different types of material being compacted using one and the same device.

The arrangement of the invention is for generating a mechanical vibration including: a mass; first and second force cells for generating first and second rotating force vectors to form a resultant force acting on the mass to impart mechanical vibration thereto; the first force cell including a first rotating eccentric to generate the first rotating force vector; an electrically controlled first drive for rotating the first rotating eccentric; and, a first angle sensor for detecting the angular position of the first rotating eccentric relative to a reference direction and outputting a first signal indicative thereof; the second force cell including a second rotating eccentric to generate the second rotating force vector; an electrically controlled second drive for rotating the second rotating eccentric; and, a second angle sensor for detecting the angular position of the second rotating eccentric relative to the reference direction and outputting a first signal indicative thereof; and, the electrically controlled first drive being separate from the electrically controlled second drive.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
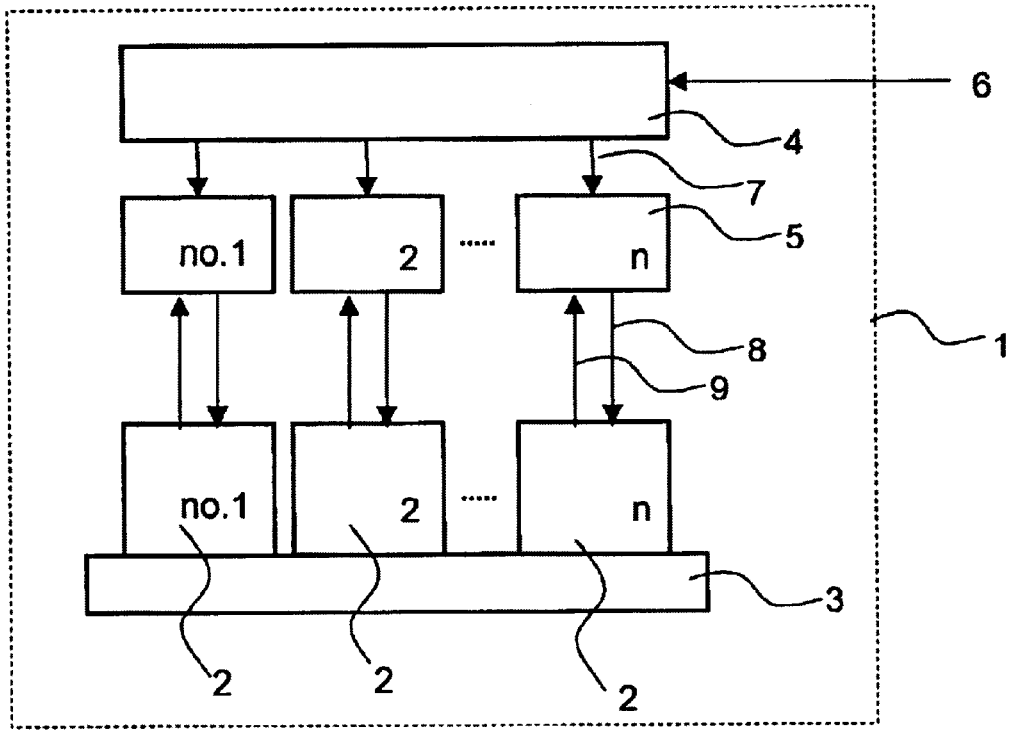
FIG. 1 is a block diagram of an embodiment of the arrangement of the invention for generating a mechanical vibration.
Figure 2:
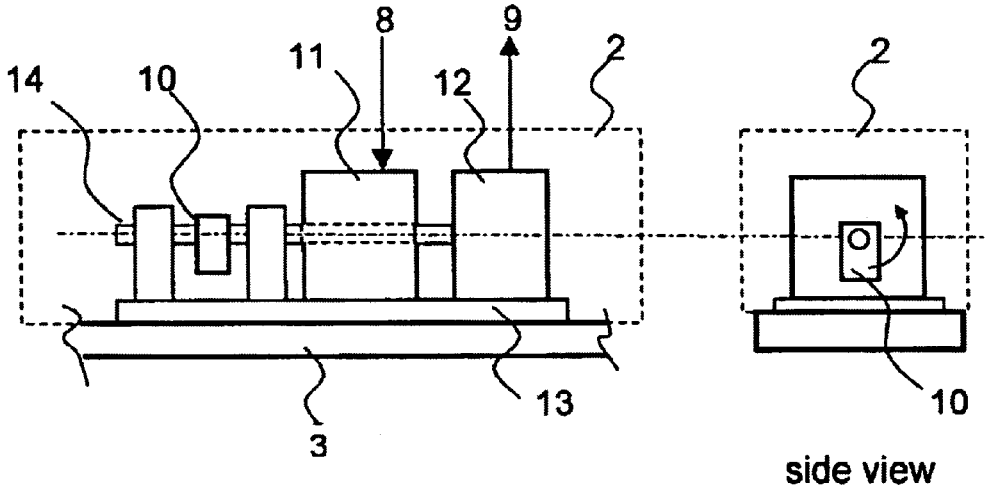
FIG. 2 shows two views of the arrangement of the invention for generating mechanical vibrations.

The invention is characterised thereby, in that the generation of vibration is made by a system 1 of two or more so-called force vector cells 2 and where a rotating eccentric 10 in each force vector cell generates a circular rotating force vector. All force vector cells 2 generate a force vector that acts in the form of a resulting force vector on the common mass 3. Each eccentric 10 is rotated by a separate electrically controlled drive 11, e.g., electric motor, hydraulic motor, and where the angular position of each eccentric in relation to a reference direction is measured by an angle sensor 12 with electric output signal 9. Rotation of each eccentric with regard to rotation frequency, direction of rotation and phase position is controlled by a control and monitoring system 5 by a control signal 8 to the drive 11.

With control signal 6, a superior control device 4 determines signal 7, containing a rotation frequency, a direction of rotation and a phase position for each force vector cell 2 to achieve a determined resulting force vector diagram. The control devices 4 and 5 are at present based on microcomputers for advanced control and monitoring and simple re-programming of the vibration characteristics.

By choosing a suitable number of eccentrics 10, centrifugal force of the eccentrics, frequency, direction of rotation and phase position, it is possible to generate a force vector diagram of suitable form, in space and time.

With one and the same configuration of force vector cells 2, many different types of force vector diagrams can be obtained. The form of the resulting dynamic force vector diagram can easily be optimised with regard to factors such as the degree of compaction, direction of movement of the compacting appliance and the static force vector from the mass of the appliance. The invention also allows the force vector diagram to be "modulated" by varying the speed of rotation and phase position of the eccentrics in time. For the compacting of certain types of material, optimisation can be achieved since the vibration is composed of several different frequencies (multi-frequency vibration). The invention described also allows an existing apparatus to be easily "re-programmed" to conform to force vector diagrams that have been tested and to new types of material that need to be compacted.

Figure 4:
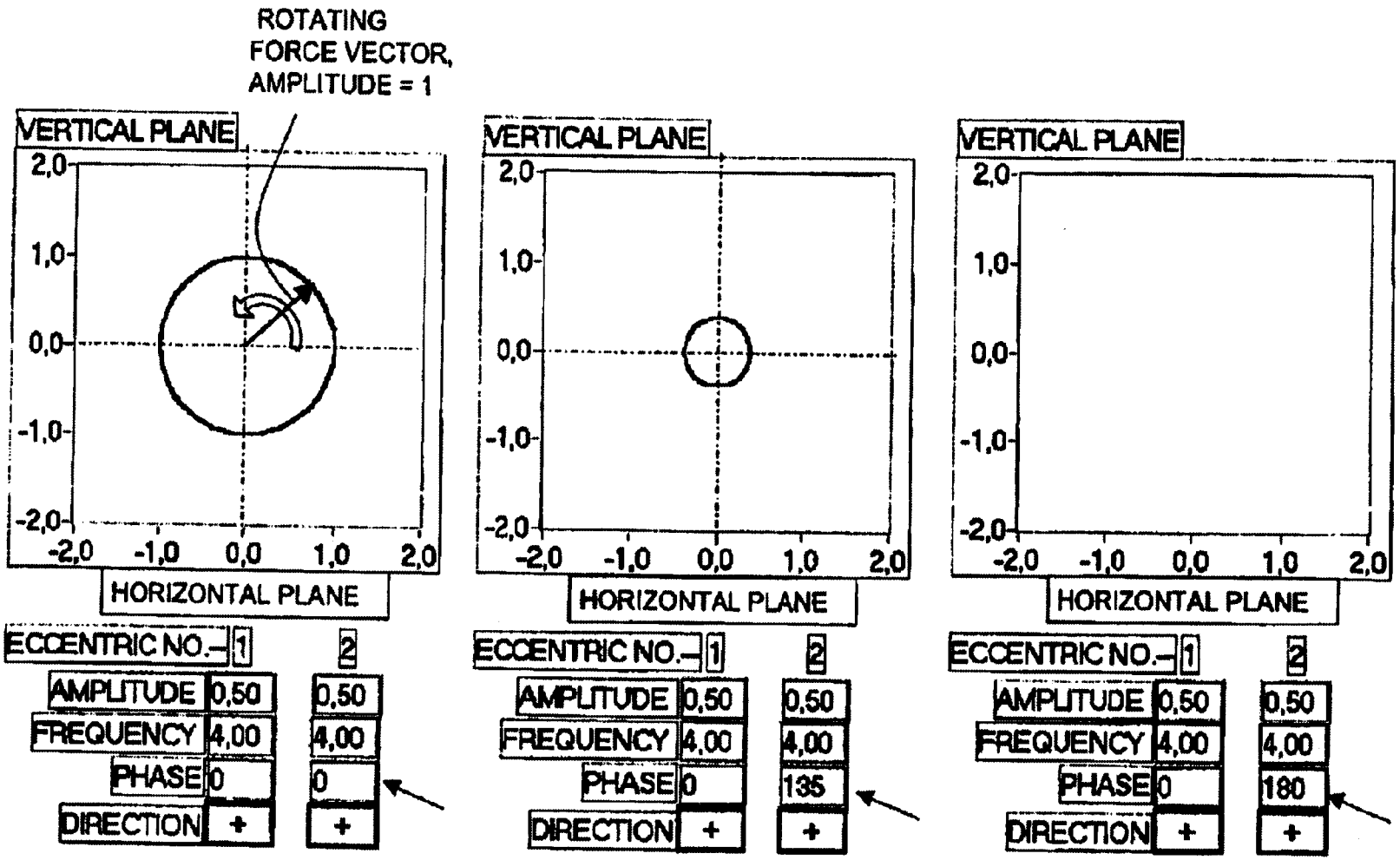
FIG. 4 presents three vector diagrams showing the amplitude of the rotating force vector for a phase difference between eccentrics of 0°, 135° and 180° in an arrangement of the invention having two force vector cells.

See FIGS. 4–7 for some typical force vector diagrams that can be achieved:

FIG. 4: Circular force vector diagram with adjustable amplitude: The vibration system consists of two force vector cells, where the eccentrics rotate in the same direction and at the same rotational speed and where the phase difference can be regulated. This results in a circular force vector with amplitude that is adjustable between 0 and maximum depending on the phase difference between the eccentrics. The figure shows amplitude of the rotating force vector for the phase differences 0, 135 and 180°.

Figure 5:
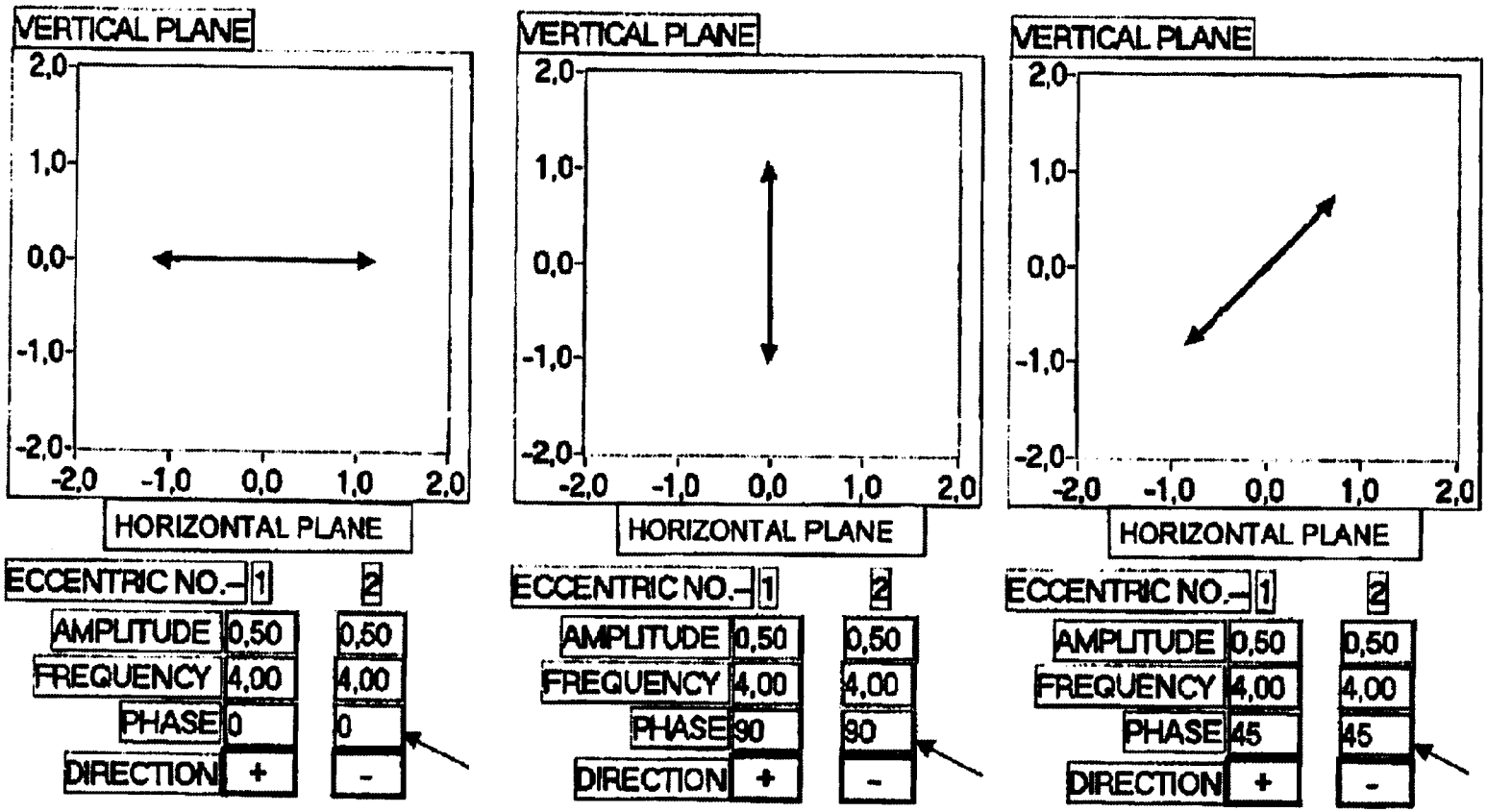
FIG. 5 presents a force vector with adjustable direction and fixed amplitude and showing how displacing the phase position 0°, 90° and 45° in relation to the reference direction can rotate the force vector.

FIG. 5: Force vector with adjustable direction and fixed amplitude, The vibration system consists of two force vector cells, where the eccentrics rotate in opposite directions and at the same rotational speed and where their phase position can be regulated. This results in a linear force vector that acts in one direction only (+/−) and at fixed amplitude. Direction of the force vector depends on when the centrifugal forces of both eccentrics interact in one direction for each revolution. The figure shows how displacing the phase position 0, 90 and 45° in relation to the reference direction can turn the force vector.

Figure 6:
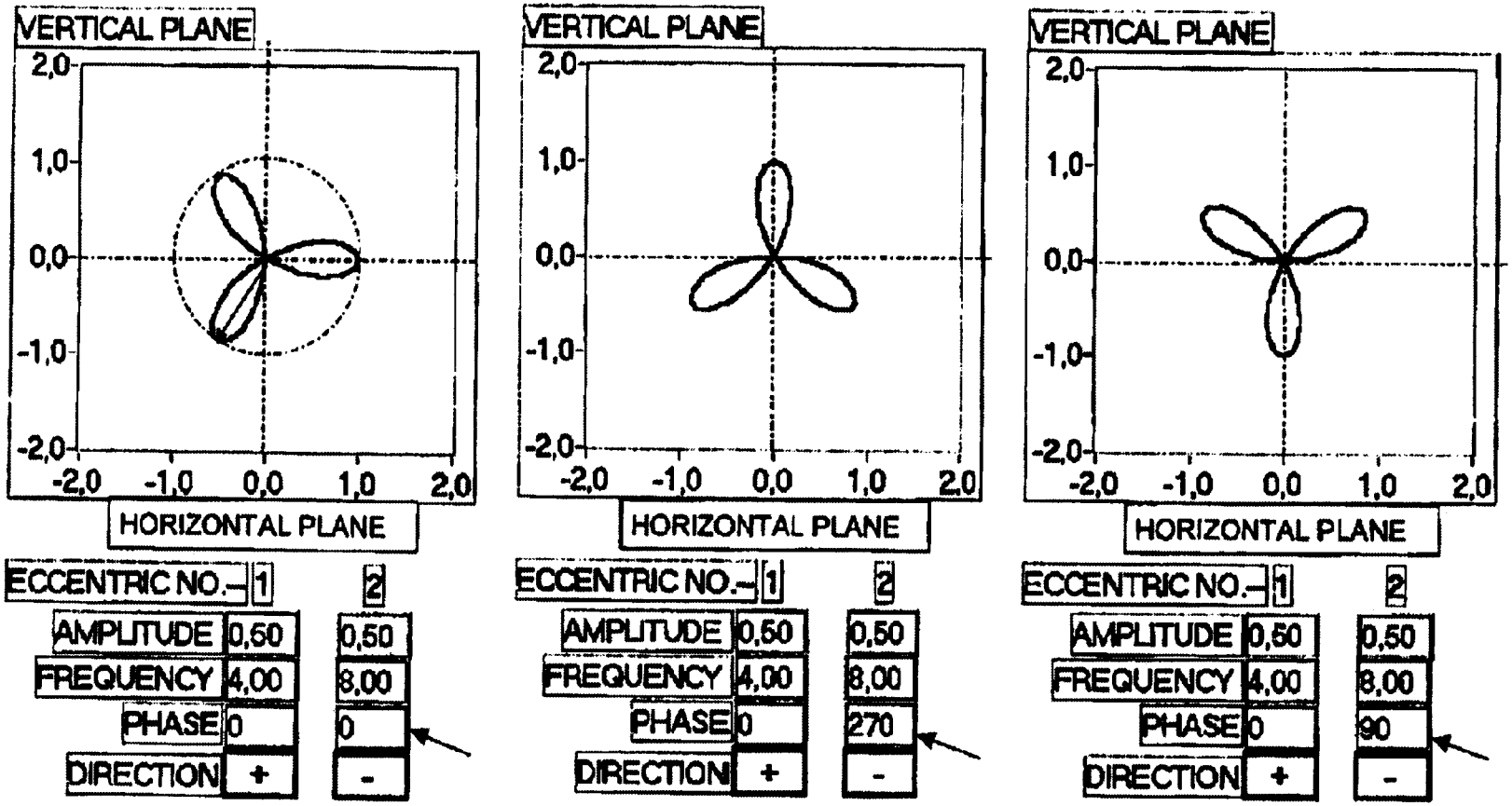
FIG. 6 presents a force vector with adjustable direction and fixed amplitude; and, FIGS. 7A and 7B show vector diagrams for a vibration system having three force vector cells wherein the eccentrics 1 and 3 rotate in the same direction and eccentric 2 rotates in the direction opposite thereto.

FIG. 6: Force vector with adjustable direction and fixed amplitude, The vibration system consists of two force vector cells, where the eccentrics rotate in opposite directions and where eccentric 2 rotates at double the rotational speed compared to eccentric 1. By giving eccentric 2 different phase positions a force vector diagram with different combinations of depth and surface effect can be obtained.

Figure 7B:
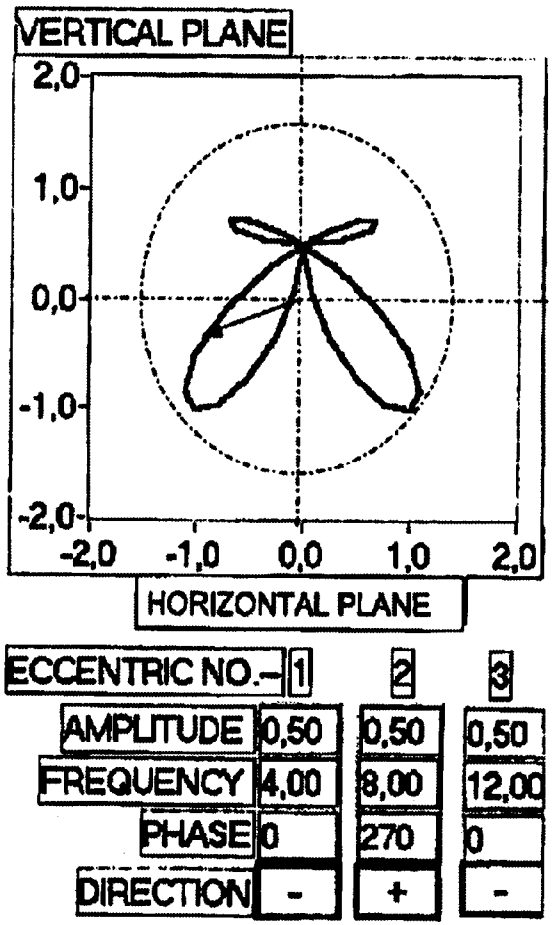
Figure 7A:
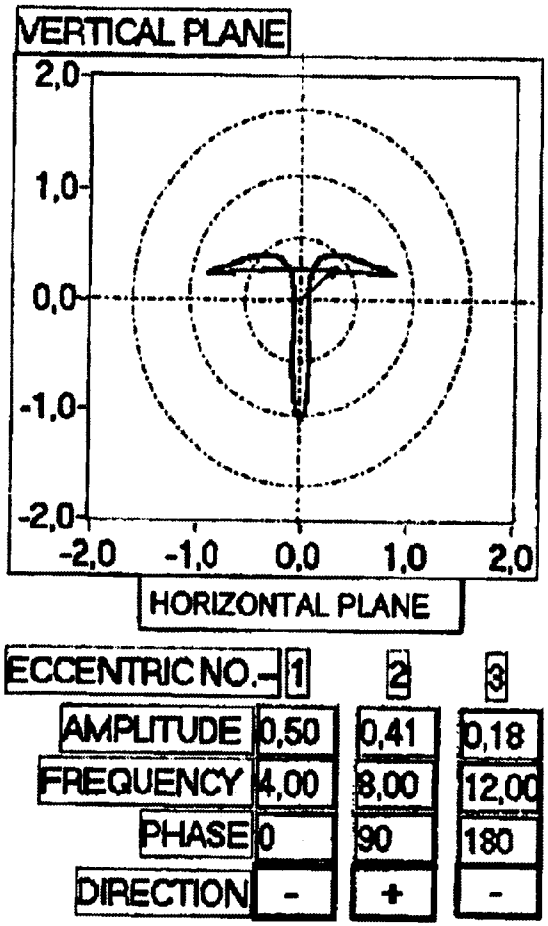

FIG. 7A: The vibration system consists of three force vector cells, where the eccentrics 1 and 3 rotate in the same direction and eccentric 2 in the opposite direction. Speed of rotation for eccentric 1=4 Hz, eccentric 2=8 Hz, eccentric 3=12 Hz. Amplitude of eccentric 1=0.5, eccentric 2=0.41, eccentric 3=0.18.

With these settings a force vector that acts in depth for a short period is obtained. Changing the phase position of the eccentrics turns the direction.

FIG. 7B: The vibration system consists of three force vector cells, where the eccentrics 1 and 3 rotate in the same direction and eccentric 2 in the opposite direction. Speed of rotation for eccentric 1=4 Hz, eccentric 2=8 Hz, eccentric 3=12 Hz. Amplitude of eccentric 1=0.5, eccentric 2=0.5, eccentric 3=0.5. With these settings a force vector is obtained that has combined surface and depth effect. Changing the phase position of the eccentrics turns the direction.

Figure 3:
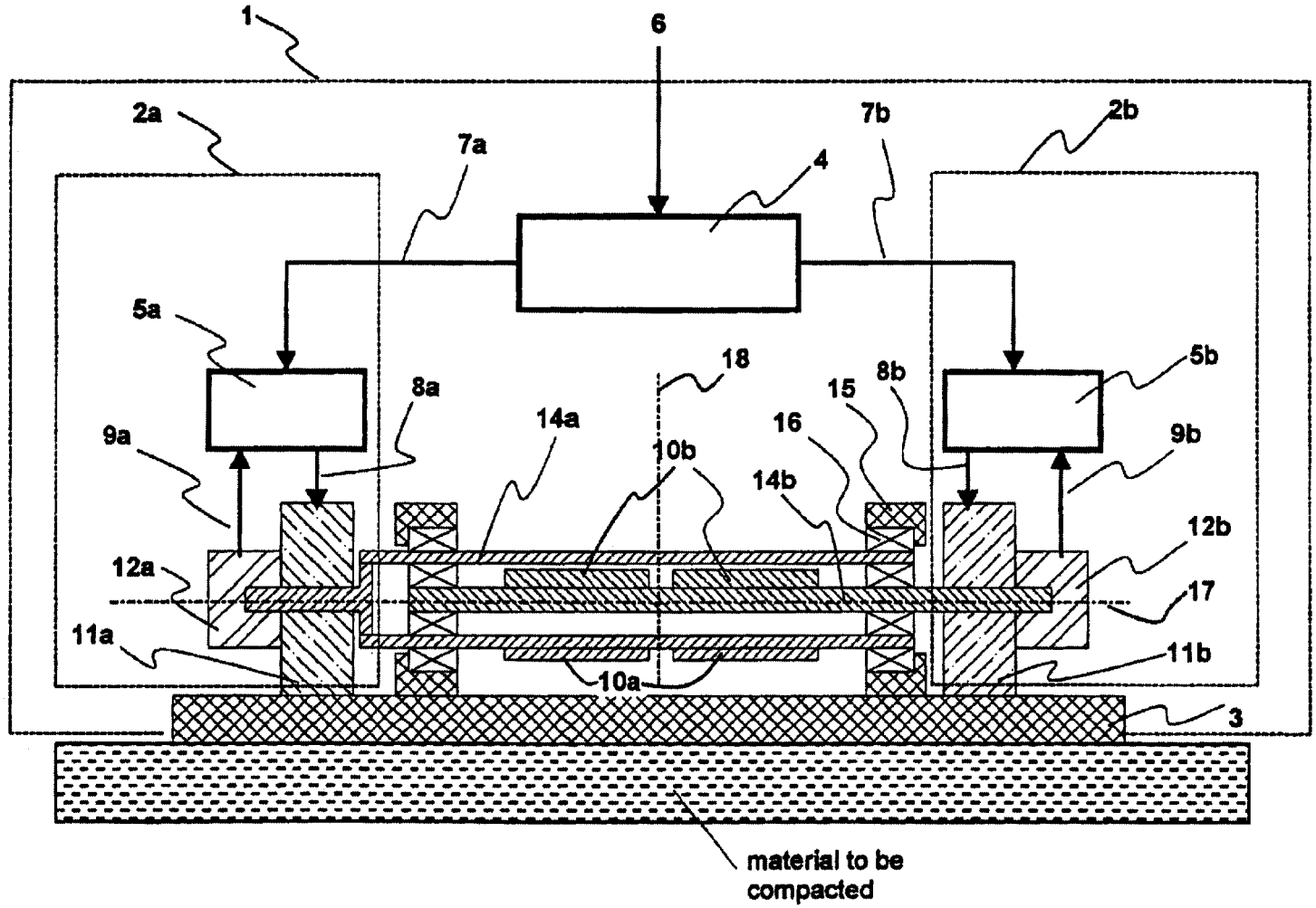
FIG. 3 is a more detailed schematic of the arrangement of the invention equipped with two force vector cells.

The execution form according to FIG. 3 is a device with two force vector cells 2*a,* 2*b,* where the eccentrics have coaxial location. This implies that the outer eccentric 10*a* rotates round the inner eccentric 10*b*. This location means that the mass centre (centre of gravity) of the eccentrics has the same axis of rotation 17 and the same rotation plane 18, which is of significance for the resulting force vector for both of the eccentrics. The axles 14*a* and 14*b* are carried by a number of bearings 16 so that they can rotate freely in relation to one another and to the holder 15. The principle of coaxial located eccentrics can also be used for 3 or more eccentrics. The cells are mounted on a common plate 3 the mass of which shall vibrate to compact the underlying material. The eccentrics 10*a,* 10*b* rotate with the respective axle 14*a* and 14*b,* which are common for the respective electric motor 11*a,* 11*b* and respective angle sensor 12*a,* 12*b*. The motor 11*a,* 11*b* is fed from the control device 5*a,* 5*b* by a voltage 8*a,* 8*b* that determines the direction and speed of rotation for the axle 14*a,* 14*b*. From angle sensor 12*a,* 12*b* a signal 9*a,* 9*b* is given that is the angle value of the eccentric 10*a,* 10*b* in relation to a reference direction which, for example, can be in the horizontal plane. The signal 7*a,* 7*b* from the control device 4 is the desired value for the direction of rotation, speed of rotation and phase position for the eccentric 10*a,* 10*b*. From the signal 9*a,* 9*b* from the angle sensor 12*a,* 12*b* the control device 5*a,* 5*b* calculates the value of the real direction of rotation, speed of rotation and phase position for the eccentric 10*a,* 10*b*. Consequently, these values form the actual value of the control system.

The control device 5*a,* 5*b* regulates with the voltage 8*a,* 8*b* the electric motor 11*a,* 11*b* so that the desired value and the actual value are the same.

The signal 6 gives the parameters for the operational case to the control device 4. The parameters can for example be the frequencies for the vibration, form of the force vector diagram and modulation.

What is claimed is:

1. An arrangement for generating a mechanical vibration comprising:

a mass;

a plurality of vector force cells and first and second ones of said force cells being for generating first and second rotating force vectors to form a resultant force vector acting on said mass to impart mechanical vibration thereto;

said first force cell including a first rotating eccentric to generate said first rotating force vector; an electrically controlled first drive for rotating said first rotating eccentric; and, a first angle sensor for detecting the angular position of said first rotating eccentric relative to a reference direction and outputting a first signal indicative thereof;

said second force cell including a second rotating eccentric to generate said second rotating force vector; an electrically controlled second drive for rotating said second rotating eccentric; and, a second angle sensor for detecting the angular position of said second rotating eccentric relative to a reference direction and outputting a second signal indicative thereof;

said electrically controlled first drive being separate from said electrically controlled second drive;

said first force cell including a first control and monitoring device connected to said first angle sensor for receiving said first signal;

said second force cell includes a second control and monitoring device connected to said second angle sensor for receiving said second signal;

a primary control unit connected to said first and second control and monitoring devices;

said primary control unit functioning to generate first and second control signals for setting a rotational frequency, direction of rotation and phase position for said first and second force cells, respectively;

said first control and monitoring device receiving said first control signal and functioning to calculate the direction of rotation, speed of rotation and phase position of said first rotating eccentric based on said first signal and to then generate a first drive signal for said first drive to regulate the direction of rotation, speed of rotation and phase position thereof;

said second control and monitoring device receiving said second control signal and functioning to calculate the direction of rotation, speed of rotation and phase position of said second rotating eccentric based on said second signal and to generate a second drive signal for said second drive to regulate the direction of rotation, speed of rotation and phase position thereof; and, said primary control unit having an input for receiving a control signal indicative of parameters for a specific force vector diagram and functioning to determine the direction of rotation, speed of rotation and phase position of each of said first and second rotating eccentrics based on said parameters.

2. An arrangement for generating a mechanical vibration comprising:

a mass;

a plurality of vector force cells and first and second ones of said force cells being for generating first and second rotating force vectors to form a resultant force vector acting on said mass to impart mechanical vibration thereto;

said first force cell including a first rotating eccentric to generate said first rotating force vector; an electrically controlled first drive for rotating said first rotating eccentric; and, a first angle sensor for detecting the angular position of said first rotating eccentric relative to a reference direction and outputting a first signal indicative thereof;

said second force cell including a second rotating eccentric to generate said second rotating force vector; an electrically controlled second drive for rotating said second rotating eccentric; and, a second angle sensor for detecting the angular position of said second rotating eccentric relative to a reference direction and outputting a second signal indicative thereof;

said electrically controlled first drive being separate from said electrically controlled second drive; and, said first and second rotating eccentrics being rotatably journalled to conjointly define a common geometric axis of rotation and said first and second rotating eccentrics have a mass center whose axis of rotation corresponds to said axis of rotation and rotates in approximately the same geometric plane.

3. An arrangement for generating a mechanical vibration comprising:

a mass;

a plurality of vector force cells and first and second ones of said force cells being for generating first and second rotating force vectors to form a resultant force vector acting on said mass to impart mechanical vibration thereto;

said first force cell including a first rotating eccentric to generate said first rotating force vector; an electrically controlled first drive for rotating said first rotating eccentric; and, a first angle sensor for detecting the angular position of said first rotating eccentric relative to a reference direction and outputting a first signal indicative thereof;

said second force cell including a second rotating eccentric to generate said second rotating force vector; an electrically controlled second drive for rotating said second rotating eccentric; and, a second angle sensor for detecting the angular position of said second rotating eccentric relative to a reference direction and outputting a second signal indicative thereof;

said electrically controlled first drive being controlled separately from said electrically controlled second drive;

a common control system operatively connected to said first and second force cells; and, said first and second rotating eccentrics being rotatably journalled to conjointly define a common geometric axis of rotation and said first and second rotating eccentrics have a mass center whose axis of rotation corresponds to said common geometric axis of rotation.

* * * * *